US009196116B2

(12) United States Patent
Szrek et al.

(10) Patent No.: US 9,196,116 B2
(45) Date of Patent: Nov. 24, 2015

(54) SECURING GAMING TRANSACTIONS

(75) Inventors: Walter Szrek, East Greenwich, RI (US); Irena Szrek, East Greenwich, RI (US)

(73) Assignee: SZREK2SOLUTIONS LLC, East Greenwich, RI (US)

( * ) Notice: Subject to any disclaimer, the term of this patent is extended or adjusted under 35 U.S.C. 154(b) by 1207 days.

(21) Appl. No.: 11/683,589

(22) Filed: Mar. 8, 2007

(65) Prior Publication Data

US 2007/0213125 A1 Sep. 13, 2007

Related U.S. Application Data

(60) Provisional application No. 60/743,442, filed on Mar. 9, 2006.

(51) Int. Cl.
*A63F 9/24* (2006.01)
*G07F 17/32* (2006.01)

(52) U.S. Cl.
CPC ..... *G07F 17/3241* (2013.01); *G07F 17/32* (2013.01); *G07F 17/329* (2013.01)

(58) Field of Classification Search
CPC ..... H04L 63/08; H04L 63/0428; H04L 2463/102; G06F 21/31; G06F 2221/2115; G06F 17/3225; G06F 17/3241; G06F 7/084
USPC ..... 463/20–30, 42; 705/39, 75; 713/194
See application file for complete search history.

(56) References Cited

U.S. PATENT DOCUMENTS

| | | | | |
|---|---|---|---|---|
| 6,368,219 | B1 * | 4/2002 | Szrek et al. | 463/42 |
| 6,527,638 | B1 * | 3/2003 | Walker et al. | 463/25 |
| 6,866,586 | B2 * | 3/2005 | Oberberger et al. | 463/42 |
| 6,935,951 | B2 * | 8/2005 | Paulsen et al. | 463/25 |
| 7,043,641 | B1 * | 5/2006 | Martinek et al. | 713/187 |
| 2002/0010684 | A1 * | 1/2002 | Moskowitz | 705/75 |
| 2002/0049909 | A1 * | 4/2002 | Jackson et al. | 713/188 |
| 2003/0004871 | A1 * | 1/2003 | Rowe | 705/39 |
| 2003/0054886 | A1 * | 3/2003 | Lion et al. | 463/42 |
| 2004/0039695 | A1 * | 2/2004 | Rowe | 705/39 |
| 2005/0223231 | A1 * | 10/2005 | Zhang et al. | 713/178 |

* cited by examiner

*Primary Examiner* — Steve Rowland
(74) *Attorney, Agent, or Firm* — Armstrong Teasdale LLP

(57) ABSTRACT

Providing tamper-evident transaction data for transactions relating to a draw or game event such as a lottery or other game of chance or skill. The transactions, individually, as a whole draw or event file, or in batches, are digitally time-stamped using a cryptographic device to create digital signatures. The resulting, signed, transaction file is capable of subsequent verification to enable detection of alteration of the transaction data and the time it was processed. The efficient time-stamping occurs quickly, does not require custom software on the gaming system, and ensures transaction integrity.

15 Claims, 6 Drawing Sheets

SECURING GAMING TRANSACTIONS

CROSS-REFERENCE TO RELATED APPLICATION

This application claims the benefit of U.S. provisional patent application No. 60/743,442, filed Mar. 9, 2006.

BACKGROUND

Lotteries and other gaming organizations consider security and integrity of their games one of the key factors of their operations. A lottery draw, when winning numbers are selected and prizes for games are calculated, is an important element of such gaming organizations. There have been attempts to ensure security of the draw and guarantee that all valid transactions sold for a game, and only such transactions, participate in the draw. Various processes have been used by lotteries to secure the file containing the numerous transactions. These prior attempts include storing the transaction file on a physical media (e.g., disc, tape, and CD ROM) and securing the media. It is common to ensure the integrity of the transactions by use of some form of data checksum or hash calculation. Also, cryptographic technology such as digital signatures is commonly used for the purpose of securing information generally.

Prior methods for securing the transaction file in gaming applications, however, suffer from many drawbacks. These methods are only secure to a point where the procedure of securing the transaction file is performed as defined. In other words, conventional methods rely on the personnel to actually follow the specified procedure. If a procedure is compromised, and a transaction file is manipulated by an insider, there is no way to detect this breach of security. Even if a digital signature is used to secure the transaction file, there is no guarantee that the signature was generated before the gaming event (e.g., the draw). Some jurisdictions use a particular form of digital time-stamping that inefficiently requires significant changes to the gaming software.

Also, conventional efforts at calculating a hash for a digital signature of a transaction file take a relatively long time, especially for large files containing millions of transactions. Because the security procedure must be finished before the draw or other game event starts, the time needed to perform the procedure is essential; that is, it is often critical to reduce the time between the end of sales and the game event to a minimum. Players like to enter gaming transactions (i.e., place bets, pick numbers, make wagers, etc.) as close to a game event as possible and the game providers wish to make their games most attractive to maximize sales. Consequently, the current methods deployed for securing the transactions calculate the transaction hash in real time while sales take place. Unfortunately, there are many technical issues related to real time hash calculations of gaming transactions that undermine its usefulness. In lottery applications, for example, certain transactions may modify some already calculated data (e.g., cancellation of a transaction may change the original transaction and invalidate an already calculated hash, so the data has to be restored to its original state for verification). Accommodating these issues requires extensive software implementation.

Another shortcoming of currently used security methods is that they are usually gaming system specific and dependent on the exact format of the transaction file. Consequently, they may require significant implementation effort on the lottery system when being developed or modified for new games. This is costly and introduces time delays required to develop code and test it, as well as a risk factor when installing new code on the lottery system. This affects potentially both the online lottery and gaming system on which the transaction file signature is generated and an Internal Control System (ICS) on which the signature is verified.

Existing gaming processes lack the ability to secure transactions in real time or at a time before a draw or game event in a way that cannot be compromised. Further, existing gaming processes lack an ability to prove and verify that the transactions participating in a draw or game event were not compromised. Existing gaming processes also lack the ability to secure transactions within a short time that is acceptable for the type of game or event. Although existing gaming processes provide transactions with a security function, they cannot do so in a way that avoids extensive development work on the side of the gaming system or ICS system.

SUMMARY

Embodiments of the invention secure gaming transactions by digitally signing transaction data representing one or more transactions created for a game. In an embodiment, the invention receives the transaction data from a gaming system and calculates a one-way hash of the received transaction data. The one-way hash is digitally time-stamped and stored for subsequent verification of the transactions.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Other features will be in part apparent and in part pointed out hereinafter.

BRIEF DESCRIPTION OF THE DRAWINGS

Corresponding reference characters indicate corresponding parts throughout the drawings.

DETAILED DESCRIPTION

Aspects of the invention relate to the lottery and gaming industries. More specifically, aspects of the invention relate to the game drawing process and, particularly, to ensuring that all recorded transactions participating in a draw or game event are secured before a draw or event. Embodiments of the invention provide a cost effective and time efficient method to secure lottery or other gaming transactions before a game event such as a draw so that they cannot be altered and there is a proof that they were not altered.

Embodiments of the invention introduce a notion of a transaction server or depot where transaction files or transactions are sent to be time-stamped to ensure their content at a specific time, i.e., at the time of the time-stamp. Embodiments of the invention are also operable in applications where proving the time is not critical. Such embodiments use, for example, standard digital signatures.

In aspects of the invention, those skilled in the art are familiar with an environment in which the lottery or gaming system is capable of communicating with a system that secures transaction files and may transfer a transaction file to that system or transfer transactions in batches or one by one (called remote logging) to that system for time-stamping. As a result, the system that secures transaction files may obtain all transactions participating in a lottery draw or game event before the draw or event. For example, aspects of this invention utilize a gaming server or a TRUSTED TRANSACTIONS (TT) server for originating and/or controlling the transfer.

Figure 1:
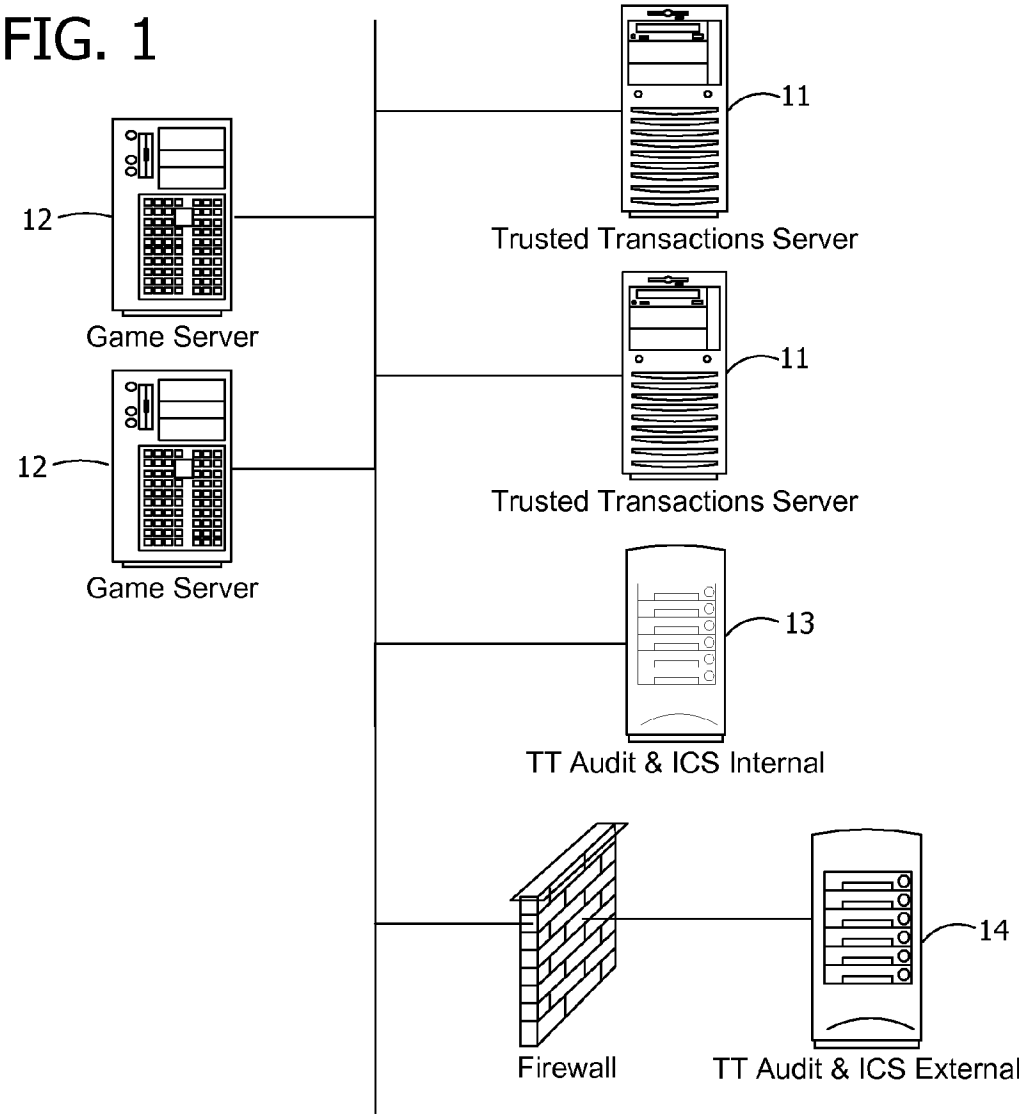
FIG. 1 is a diagrammatic view of the system architecture according to embodiments of the invention.

Referring first to FIG. 1, an exemplary system architecture is shown. In particular, FIG. 1 presents a high level architecture of the TT system according to aspects of the invention. The TT system is distributed and includes two or more TT servers 11 available to process the transaction file from one or more game servers 12, to ensure that in case of one TT server being down, another is operational. One or more TT audit systems 13 are provided in accordance with embodiments of the invention where one may be used by the lottery staff, and another by an auditor, such as a third party auditor or internal audit within a gaming organization. The game servers include any kind of betting system, such as an online lottery, Internet betting system, mobile betting system, sports, racing or skills betting, and any other computerized betting system in any variety of configurations.

In FIG. 1, the game servers 12 provide transactions to TT servers 11 by file transfer, real-time logging, or sending transactions for time-stamping. Game servers 12 may transfer files with all bets and winners to TT audit 13 for verification. The TT servers 11 receive transactions from game servers 12. TT servers 11 timestamp the transactions and send the timestamp and optionally the file with bets to TT audit 13. TT audit 13 verifies transactions and associated timestamps. Optional ICS verifies winners. An external TT audit 14 may be separated by a firewall and connected by virtual private network.

Embodiments of the invention include the following.

A. Transfer of the transaction file before a draw or event to a secure server, and a very fast calculation of a one-way hash and time-stamping of the file. One-way hash may be performed on a whole transaction file with millions of transactions in a short time before the draw, instead of real time hash calculation. For example sending a file with 10 million transactions and time-stamping these transactions may currently take less than 1 minute.

B. Transfer of the transaction file continuously in real time while periodically or continuously calculating new file hashes and digitally time-stamping them, logging at least the information allowing to recreate data provided for time-stamping (e.g., file positions of the signed data) and digital signature to allow future verification that the content of the signed information did not change.

C. Transfer of the transaction file done without interfering with any existing gaming software. Use of system or off-the-shelf provided software allows for seamless transfer of data, without need of deploying any software on the gaming system or with limited software, not requiring the interface to the gaming specialized software.

D. Reduce the cost of time-stamping, use of public time-stamping services for signing one-way hash of transactions.

A one-way hash includes, but is not limited to, an algorithmic transformation of data allowing creation of a unique digest of any input data. Any change of the input data causes the one-way hash to be different. One cannot reverse engineer the content of a one-way hash to reveal actual data used to create a one-way hash. Examples of one-way hash are SHA-1, SHA-256, and MD5.

One example of a digital signature includes a method of transforming a one-way hash of data by only the party possessing a signing key (e.g., a private key). However, any party with a corresponding key (e.g., a public key) can verify the data. Examples of digital signatures include, but are not limited to, Rivest-Shamir-Adleman (RSA) encryption, digital signature algorithm (DSA) encryption, or an elliptic curves signature.

Time-stamping is a special type of digital signature including a one-way hash of user data. A time-stamping system appends current, incorruptible clock information to the user data to be signed to provide the proof of signing time. A hardware security module (HSM) in general comprises any means or mechanism for signing data. For example, an HSM includes a cryptographic device. A time-stamping system includes, for example, an embedded HSM, an external HSM or public time-stamping service such as the U.S. Postal Service Electronic Postmark, e-TimeStamp from DigiStamp, Inc. or some other external service provider of time-stamping services. The HSM may comprise, for example, any computing device or peripheral component including a PCMCIA card or a personal computer.

The approach in embodiments of the invention is known under the trademark TRUSTED TRANSACTIONS ("TT"). Those skilled in the art will recognize that there are a variety of ways TRUSTED TRANSACTIONS may be deployed. A file with transactions is pushed to the secure server for time-stamping (time-stamping system) or the file is pulled by the process residing on the time-stamping system from the gaming system or some other intermediary system or the file is manually transferred to time-stamping system. In another example, instead of calculating the transaction file one-way hash in a short period between the end of sales and the start of draws or game events, the file is either pulled from gaming system or pushed to the time-stamping system in real time. On the time-stamping system there is a process time-stamping the transferred file repetitively in real time or during the short break between end of the sales and the draw or event. Time-stamping is a process of digitally signing data (e.g., a one-way hash of the data) together with time. Time-stamping is important because a standard digital signature provides a proof of the content of the data and it proves that the data corresponds to its signature. However in the context of securing a transaction file before a draw a traditional signature is not sufficient to guarantee integrity because a digital signature may be made at any time, even after the draw. To ensure that draw data has not been altered before the draw, the time-stamping of the data is done—a digital signature of the data generated together with time. In another embodiment, it is transactions, individually or grouped, as opposed to a transaction file that may be transferred to the TT server using a standard protocol such as XML-RPC or some other standard or custom protocol. In this case, transactions are logged and time-stamped in batches in real time. In yet another embodiment, a process residing on the TT server may query a gaming system database for new transactions and time-stamp them.

Traditional time-stamping of large files, such as lottery transaction files containing millions of wagers, is time consuming. Aspects of the invention solve this problem in numerous ways, including the following.

A. Combining a lot of information together to read and to calculate one-way hash, according to embodiments of the invention, solves the technical challenge of calculating a one-way hash of the transaction file in a very short time. After the file is read, it is time-stamped in a fraction of a second. The approach used in aspects of the invention has been tested and it has been proven that a large transaction file may be time-stamped using embodiments of this invention in a few minutes when the file is transferred just before the draw. This approach is applicable for games with relatively infrequent draws such as lotto, numbers games, etc. This approach does not require writing any specialized tools to transfer the file to TT system; however, for some embodiments such file transfer tools may be written.

B. Real time transaction file transfer and time-stamping of new data as independent chunks of data, or together with previously time-stamped data, solves the problem of time-stamping lottery transactional data in real time. As the amount of transferred data is much smaller and transferred in real time, the transaction data may be time-stamped in less than a few seconds since its creation. To be able to accomplish time-stamping, the transaction file content is being transferred and signed continuously, so time-stamping is performed in a timely manner. One advantage of this aspect of the invention is that limited or no programming is needed on the gaming system to transfer such data. Rather, any programming occurs on the TT server in an embodiment. In another embodiment, a simple utility may exist on the gaming system that helps in the real time incremental file transfer to the TT server. For some applications, file transfer may introduce its own, proprietary format for transferred files. This may be done if, for example, there is a need to keep link alive by doing a data transfer, or if this helps subsequent verification of digital signatures, or if it was helpful for security reasons, network transfers reasons, etc. This approach is suitable for high frequency games such as Keno and Bingo games, or for sporting events, where the period between the end of the sales for a product and start of the draw procedure or sporting event is very short.

C. Real time transaction logging and time-stamping is suitable, for example, for applications where time-stamping of transactions in real time is desired. As processing of the lottery transactions may require processing a volume over 1000 transactions per second (tps), traditional methods of data signing fail, as hardware security modules (HSMs) are not fast enough to accomplish it or it would be prohibitively expensive to deploy enough of them in purpose to meet such performance requirements. In embodiments of the invention, the TT system batches many transactions together and time-stamps them together in real time. For example, if the HSM can perform up to 10 digital time-stamps per second, the TT server gathers 100 milliseconds worth of transactions and time-stamps all transactions together (e.g., as or in a batch). In addition, the transactions and their respective signatures are logged, so that each batch of transactions may be verified at some later time. An entire file of transactions may be verified, transactions may be verified in batches, or transactions may be verified individually. To verify transactions individually, each transaction has its own identifier, and a verification system provides an access method using a transaction identifier to retrieve the location of transaction batch to be verified. Alternatively or in addition, the transaction batches and corresponding signatures may be stored in order of receipt to facilitate verification. The one-way hash of a transaction batch is recalculated and the digital signature of the batch is verified. This process verifies the integrity of all transactions in the batch including the integrity of the queried transaction. For example, using a batch method allows an embodiment of the invention to perform over 1000 time-stamped real time transactions per second using an HSM supporting less than 6 signatures per second, while providing a response time of less than 220 milliseconds.

An HSM is any device capable of secure cryptographic operations such as digital signing. Some HSMs have an additional capability of time-stamping.

In an embodiment, the TT server verifies integrity of the transactional data as described below.

A. A server provides information used to verify transactional data such as digital signatures or digital time-stamps, signing time, and any other relevant information. In this embodiment, another system verifies transaction integrity. This information is stored for back-up, archival or regulatory reasons, and may be provided for the independent verification or for any other reason.

B. The TT server may work as a server providing verified transactional data: individual transactions, batch of transactions, or the whole files. The TT server may verify transactional information and provide transactional information to external entities.

C. The TT server may work as a server verifying transactions provided by an external entity. External entities may provide transactional information for the transactions or files already processed by the TT server. The TT server verifies this data with the digital signatures or time-stamps stored on its system and provides a response confirming data integrity and, optionally, a transaction time.

D. The TT server may also function as a combination of any of the methods A-C above.

The verification functions may be incorporated into the TT server itself, or into another external system.

For cost reduction of the infrastructure of digital time-stamping of gaming transactions, aspects of the invention introduce the calculation of a transactional one-way hash on the game server or another system such as the TT server and the generation of a time-stamp using a third party time-stamping service such as the U.S. Postal Service Electronic Postmark, e-TimeStamp from DigiStamp, Inc., or some other external service provider of time-stamping services. Time-stamping may be done from an intermediate system, not directly from the gaming server. The game server sends a one-way hash to an intermediate system. The intermediate system requests a time-stamp from the public service. The intermediate system may store the response locally or send it back to the game server. Time-stamp and transactional data may be transferred to the verification system. The verification system recalculates a transaction's one-way hash and verifies the time-stamp.

Time-stamping has been successfully employed by some lotteries, such as those in Germany. However, currently used approaches require complex modification of the lottery transaction processing system and of the Internal Control System (ICS). The approach, according to aspects of the invention, allows deployment of the TT system with minimal or no changes to current lottery transaction processing systems, and with minimal or no changes to the existing ICS, and without prior knowledge of the specifics of transactional gaming system or the transaction format.

The technology introduced here is highly applicable for any kind of gaming such as wagering on events, lottery, sports betting, casino gaming, internet gaming, mobile gaming etc. Some of the techniques presented here such as batch method of signing may be applicable in other industries such as securities industry and banking and other applications where there is a need for a proof of the transaction integrity while large volumes of transactions are being processed in limited time.

Further examples of embodiments of the invention are next provided.

In an embodiment of the invention, the time-stamping of the systems includes one or more TT servers and one or more TT audit systems. The TT server is a system performing time-stamping of a transaction file and the TT audit is a system reading the transaction file and verifying file time-stamp. The TT server obtains a transaction file containing all transactions participating in the draw (via file transfer or real time transaction logging). It then performs time-stamping of the transaction file and sends the time-stamp to the TT audit system, which verifies the time-stamps. In another embodiment, the TT audit system also performs other Internal Control System (ICS) functions, such as winner verification.

In an embodiment, both the TT server and the TT audit systems may be deployed locally and/or remotely. The time-stamp verification may be performed remotely by a third party (e.g., an external TT audit system). The TT server and the TT audit system may use, for example, a WINDOWS brand operating system. In an embodiment for a digital time-stamp, the TT system in embodiments of the invention employ an HSM certified by the National Institute of Standards and Technology (NIST). This cryptographic hardware may be integrated with a TT system using such devices as LYNKS I or LYNKS II cryptographic tokens from SPYRUS or an external hardware HSM.

In an embodiment, the HSM device is highly secure. It is tamper proof or tamper evident and safeguards private cryptographic keys and the real time clock (RTC) contained in the HSM. The signature schema used is preferably a standard signature such as RSA, DSA or an elliptic curves signature. In an embodiment, any asymmetric encryption schema should be also regarded as a variant of digital signature schema and within the scope of aspects of the present invention.

In an embodiment, time-stamping may be combined with random numbers generation (RNG) technology as described, for example, in U.S. Pat. No. 6,934,846 entitled "Method of Generating Unpredictable and Auditable Random Numbers." In this case, transactions' one-way hash may be used as an additional input for generation of the RNG seed.

In an embodiment, the TT audit system may be also deployed with an optional ICS functionality providing automated winner selection and verification subsystem where winner selection is a process of selecting winning transactions and calculating prizes. In an embodiment, the TT audit system performs winner selection and may automatically compare winner selection outcomes generated independently on the gaming system (e.g., game server) and on the TT audit system. A game server includes, for example, a lottery or game provider's system that produces transactions and supplies transaction file for time-stamping. Further, in an embodiment, both the TT server and the TT audit may work without any operator intervention.

Figure 2:
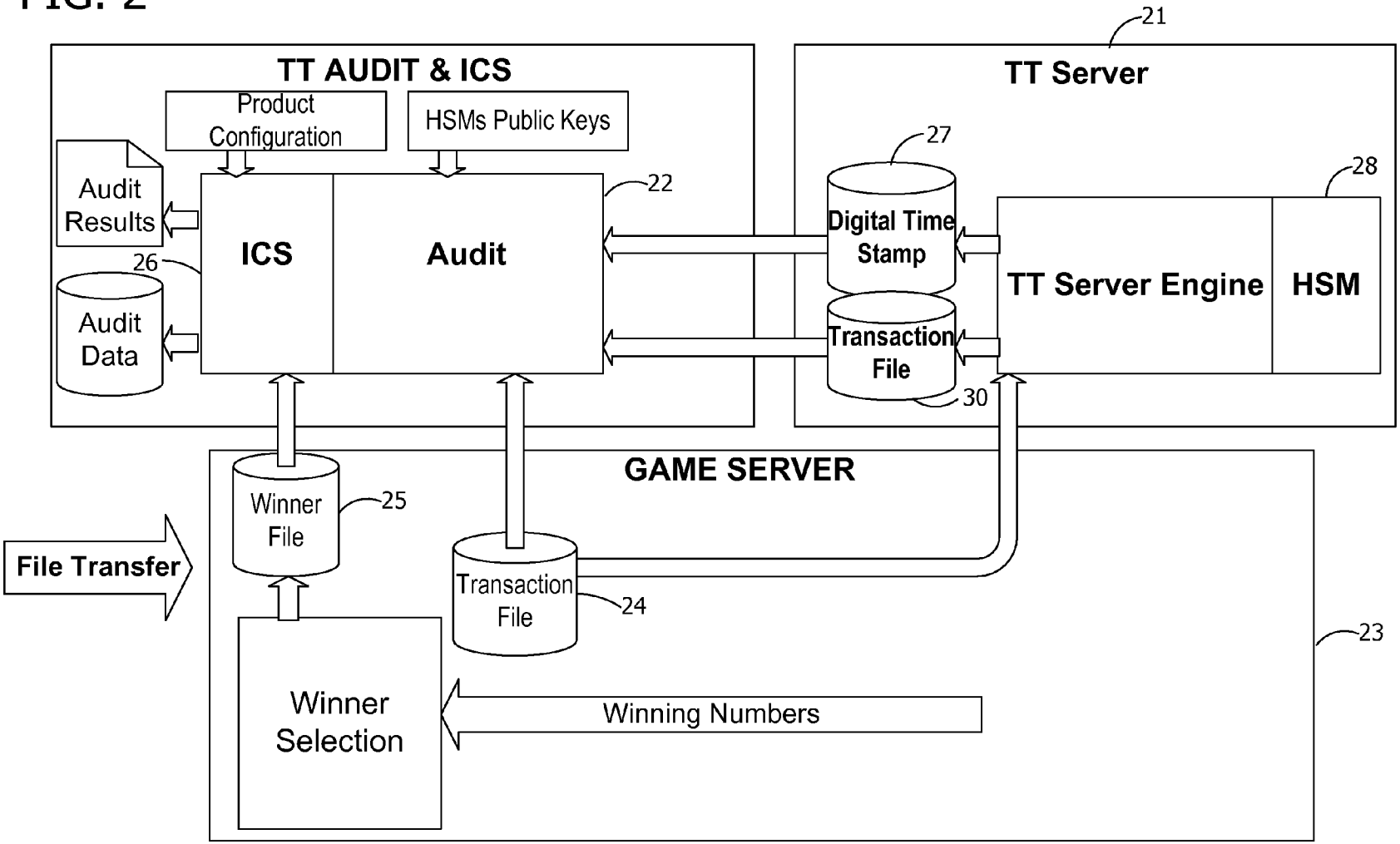
FIG. 2 is a diagrammatic view of the functions performed to secure the file before a draw.

Referring next to FIG. 2, a functionality diagram of the TT system in accordance with embodiments of the invention is shown. In this figure, it is illustrated where the transaction file 24 and optionally a winner file 25 from game server 23 is sent to TT audit systems 22 and transaction file 24 is transferred to the TT server 21. The TT server 21 generates one or more files with time-stamps of the transaction file 27 and the TT audit 22 verifies the time-stamps and an optional ICS application 26 runs a winner selection and verifies the results with the winner file 25 obtained from the game server 23. The winner file 25 may be a file with winning transactions or winner information or combination of both. In some embodiments results may be compared manually. To generate a time-stamp 27, the TT server 21 uses an external or internal HSM 28. Transfer of the game file 24 is done as a single file transfer or continues real time transfer/logging of the transaction file. In some embodiments, the transaction file maybe transferred to TT audit 22 from TT server 21. For some environments, the TT audit system 22 combines multiple transaction files 24 or 30 and digital time-stamps 27 to verify all transactions from all game servers 23.

In general, aspects of the invention comprise an interface such as TT server 21 for receiving transaction data such as transaction file 24 from the game server 23. A memory area stores the transaction file 24 received by the interface as transaction file 30. The TT server 21 computes a one-way hash of the transaction file 30. The HSM 28 digitally time-stamps the calculated one-way hash. The digitally time-stamped hash secures the transaction data from undetectable tampering.

Figure 3:
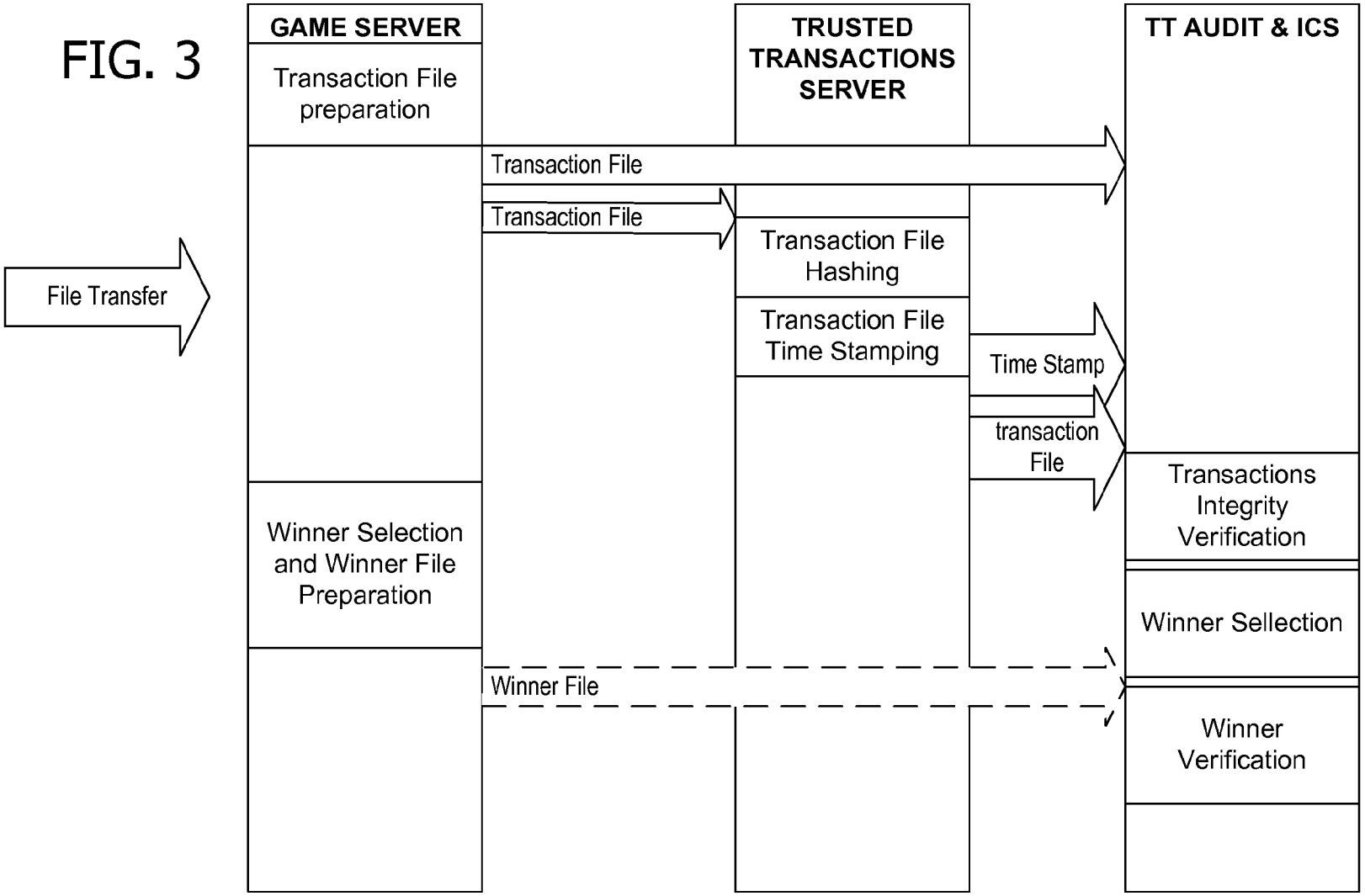
FIG. 3 is a diagrammatic view of the operational process corresponding to FIG. 2

Referring next to FIG. 3, a block diagram illustrates the data exchanged among the game server, the TT server, and the TT audit system. The block diagram in FIG. 3 corresponds to the embodiment of FIG. 2. There are many possible variations of FIG. 3: the bet file may be sent to the TT audit system from the TT server directly, TT audit functionality may be integrated into a third party ICS system, etc.

Figure 4:
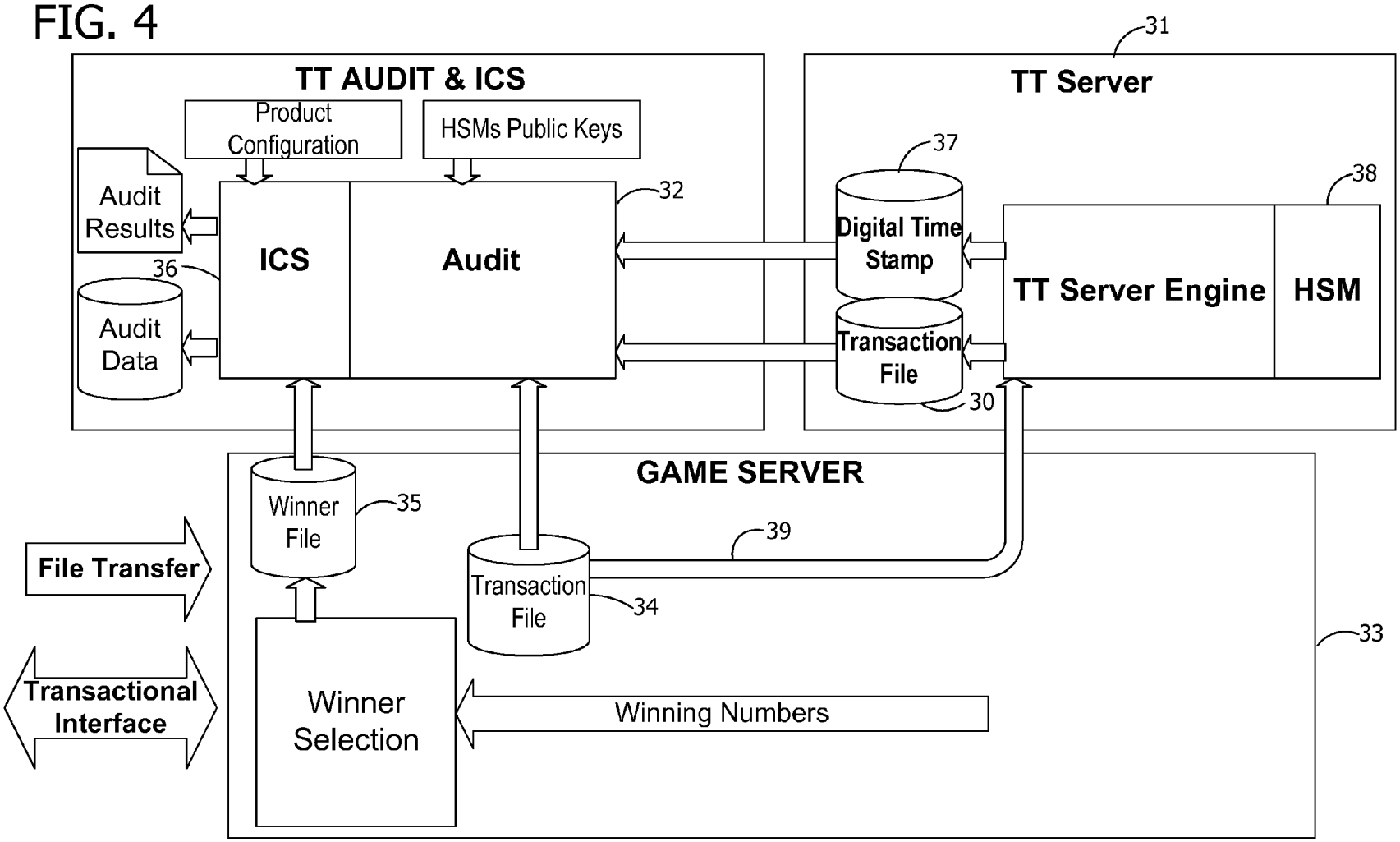
FIG. 4 is diagrammatic view of the process flow of securing the file.

Referring next to FIG. 4, a diagram of alternative, yet similar, process flow of the TT system according to aspects of the invention is illustrated. In this figure, it is illustrated where the transaction file 34 and optionally a winner file 35 from game server 33 is sent to TT audit systems 32 and transactions 34 are transferred to the TT server 31 using a transactional mechanism 39 such as XML-RPC, RMI, SOAP, SQL or any other. In an embodiment, a transactional request originates on game server 33. In some other embodiments, the request may originate at TT server 31. The TT server 31 batches the transactions for a relatively small time, usually less than 0.25 sec and generates a single digital signature or time-stamp for multiple transactions. For some embodiments, a different trigger than elapsed batching time may force performing the time-stamp earlier (e.g., a minimum number of transactions in the batch). For transactional requests originating on the game server 33, the TT server 31 returns back confirmation to the game server 33 that the digital signing was successful. The TT server 31 logs digital signatures (or time-stamps) 37 and transactions 40 to one or more files or a database (e.g., a transaction file). TT server 31 sends digital signatures 37 and the transaction file 40 to TT audit 32. TT audit 32 verifies the time-stamps and an optional ICS application 36 runs a winner selection and verifies the results with the winner file obtained from the game server. The winner file may be a file with winning transactions or winner information or combination of both. In some embodiments, results may be compared manually. To generate time-stamp 37, TT server 31 uses an external or internal HSM 38. In some embodiments the transaction file may be transferred to TT audit 32 from TT server 31. In an embodiment, TT server 31 may assign a transaction identifier to each transaction, and later each transaction may be identified by this identifier. In some other embodiments an identifier may be assigned by the game server 33. For some embodiments, both systems may assign a transaction identifier. For some environments using more than one TT server 31, TT audit system 32 may combine multiple transaction files 40 to get all transactions from all game servers.

Figure 5:
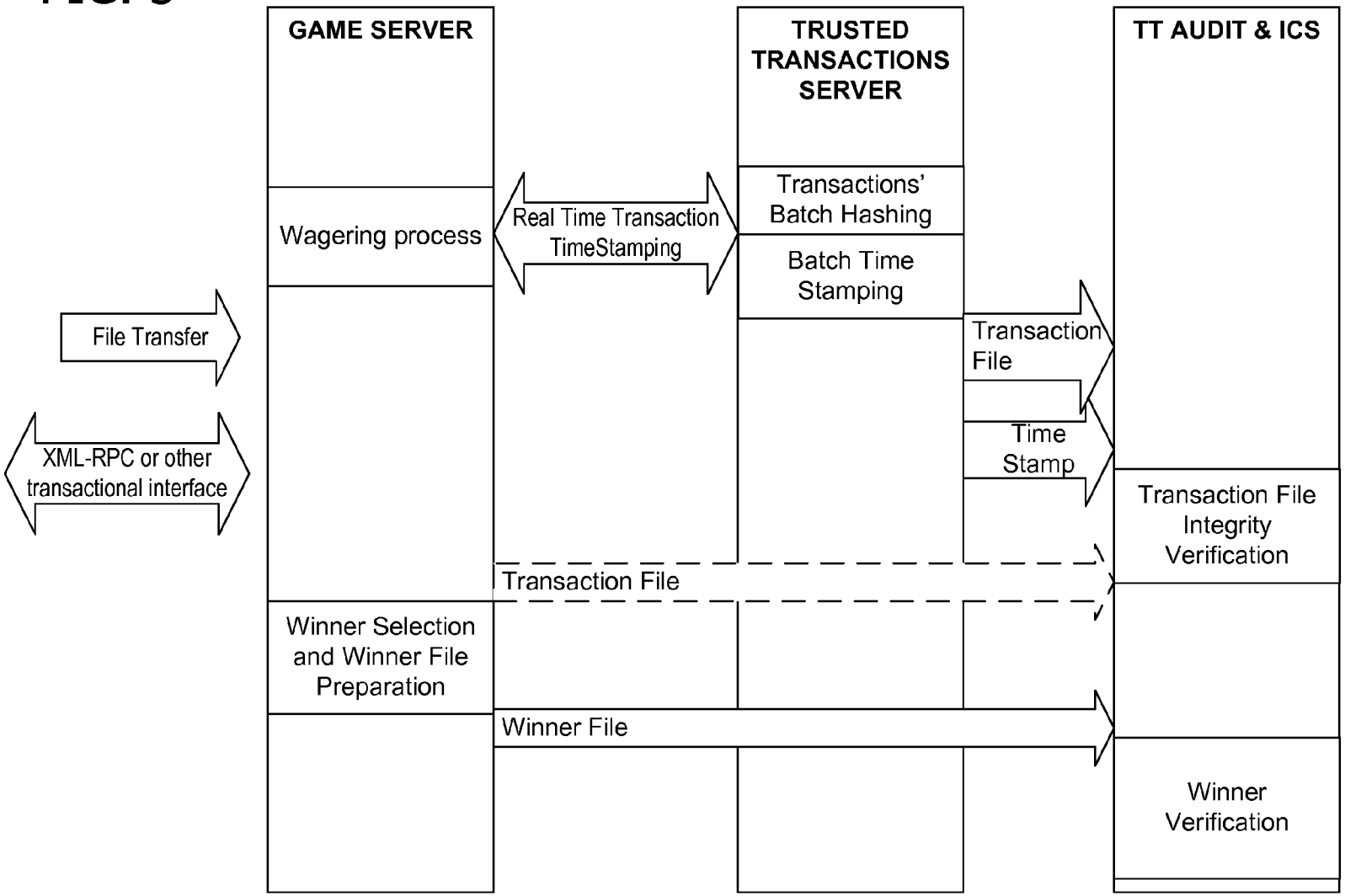
FIG. 5 is a diagrammatic view of the operational process corresponding to FIG. 4.

Referring next to FIG. 5, a block diagram illustrates exemplary data exchanged among the game server, the TT server, and the TT audit system. The block diagram in FIG. 5 corresponds to the embodiment of FIG. 4.

Figure 6:
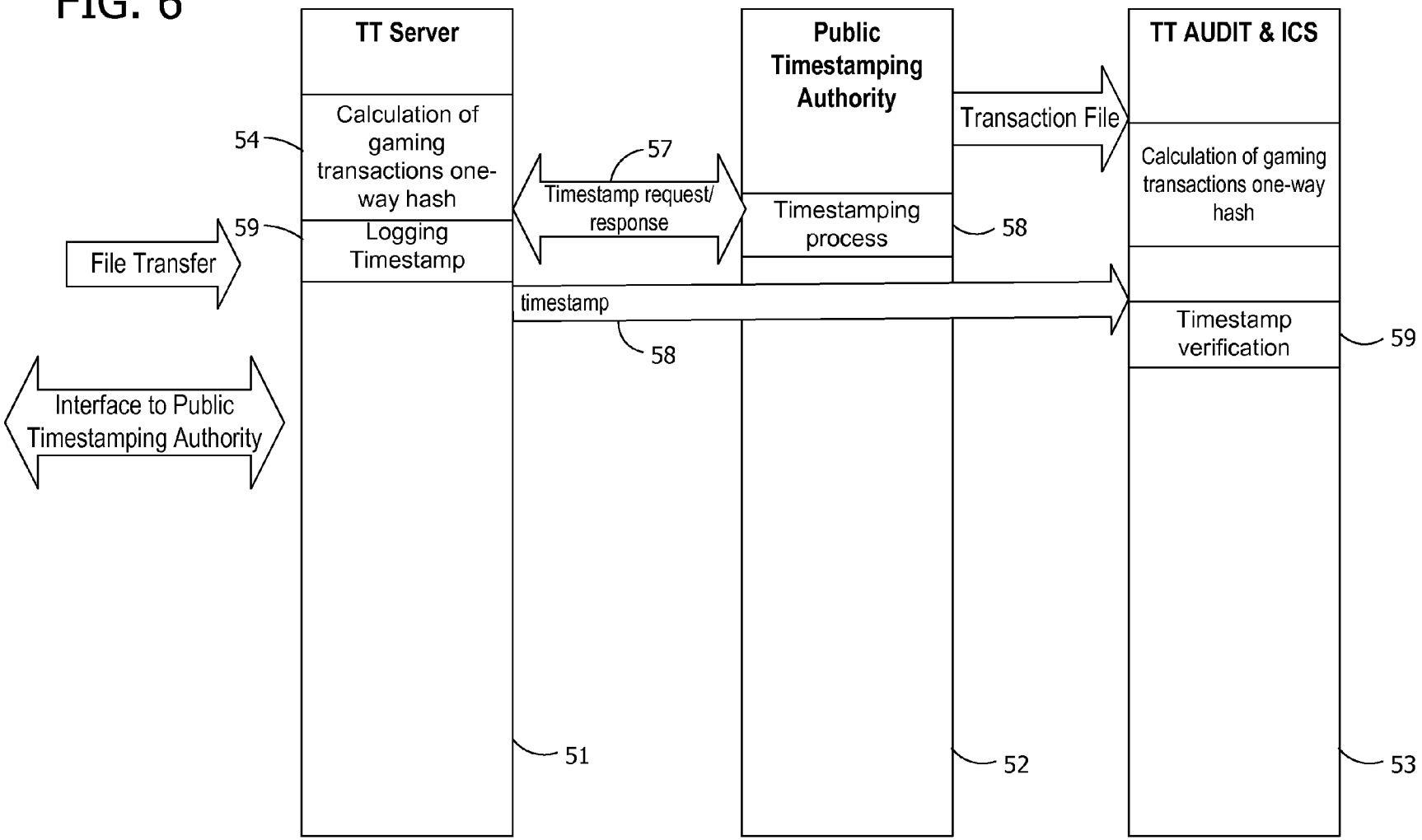
FIG. 6 is a diagrammatic view of the process of using public service for time-stamping of transactional data.

Referring next to FIG. 6, a block diagram shows the process of using a public time-stamping service. The figure shows TT server 51 using such a service. In an embodiment, this function resides on any computer. A transaction's one-way hash calculation may be done on one system, with the hash being sent to another system which requests a time-stamp from the public service.

In FIG. 6, TT server 51 calculates a one-way hash of transactions 54 and sends a time-stamp request 57 to public time-stamping service 52. Time-stamping process 58 time-stamps the transactions' hash and returns back a time-stamp. TT server logs time-stamp 59 and time-stamp is transferred electronically or manually 58 to TT audit 53. TT audit in the meantime recalculates one-way hash and compares it with one-way hash calculated by TT server 51. If hash is the same, TT audit 53 verifies the time-stamp. In an embodiment, TT server 51 is integrated with ICS functionality.

In an embodiment, the TT system is designed with security as a main design goal. Its non-refutable time-stamp proves file integrity and provides detection of modification of transactions. The TT system in embodiments of the invention is also superior to prior systems and methods at least because it allows employing redundant hardware where two, three or more TT systems may be used. To prevent against a single point of failure, more than one cryptographic HSM may be employed for each TT system. In addition, the TT server may be deployed with minimal software changes to game server.

In operation, a method of an embodiment of the invention secures gaming transactions by receiving, by a computing system, transaction data from a gaming system. The transaction data represents one or more transactions created for a game. The computing system is remote from the gaming system in an embodiment. The computing system further calculates a one-way hash of the received transaction data. A digital signature means digitally time-stamps the calculated one-way hash. The time-stamped, one-way hash is stored for subsequent verification of the transactions. An HSM or any other device capable of performing secure, cryptographic operations constitutes the digital signature means.

In another embodiment, a method secures gaming transactions by receiving a one-way hash of the transaction data from a gaming system. The gaming system calculates the one-way hash between the closing of sales of transactions for the game and a draw for the game. Descriptive information is defined for the transaction data. The descriptive information describes the transactions or the game. A one-way hash of the defined descriptive information and the received one-way hash of the transaction data is calculated. This calculated one-way hash is digitally time-stamped, by a digital signature means, to create signed data. The signed data is stored for subsequent verification of the transactions.

Exemplary Operating Environment

A computing device such as a computer is suitable to implement aspects of the invention. The computer has one or more processors or processing units and a system memory. The computer typically has at least some form of computer readable media. Computer readable media, which include both volatile and nonvolatile media, removable and non-removable media, may be any available medium that may be accessed by the computer. By way of example and not limitation, computer readable media comprise computer storage media and communication media. Computer storage media include volatile and nonvolatile, removable and non-removable media implemented in any method or technology for storage of information such as computer readable instructions, data structures, program modules or other data. For example, computer storage media include RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium that may be used to store the desired information and that may be accessed by the computer. Communication media typically embody computer readable instructions, data structures, program modules, or other data in a modulated data signal such as a carrier wave or other transport mechanism and include any information delivery media. Those skilled in the art are familiar with the modulated data signal, which has one or more of its characteristics set or changed in such a manner as to encode information in the signal. Wired media, such as a wired network or direct-wired connection, and wireless media, such as acoustic, RF, infrared, and other wireless media, are examples of communication media. Combinations of any of the above are also included within the scope of computer readable media.

The drives or other mass storage devices and their associated computer storage media provide storage of computer readable instructions, data structures, program modules and other data for the computer. The computer may operate in a networked environment using logical connections to one or more remote computers, such as a remote computer. The remote computer may be a personal computer, a server, a router, a network PC, a peer device or other common network node, and typically includes many or all of the elements described above relative to a computer. The logical connections include a local area network (LAN) and a wide area network (WAN), but may also include other networks. LAN and/or WAN networks may include wired networks, wireless networks, a combination thereof, and so on.

Aspects of the invention include the computer itself when programmed according to the methods and techniques described herein.

Although described in connection with an exemplary computing system environment, including computer, embodiments of the invention are operational with numerous other general purpose or special purpose computing system environments or configurations. The computing system environment is not intended to suggest any limitation as to the scope of use or functionality of any aspect of the invention. Moreover, the computing system environment should not be interpreted as having any dependency or requirement relating to any one or combination of components illustrated in the exemplary operating environment. Examples of well known computing systems, environments, and/or configurations that may be suitable for use with aspects of the invention include, but are not limited to, personal computers, server computers, hand-held or laptop devices, multiprocessor systems, microprocessor-based systems, set top boxes, programmable consumer electronics, mobile telephones, network PCs, minicomputers, mainframe computers, distributed computing environments that include any of the above systems or devices, and the like.

Embodiments of the invention may be described in the general context of computer-executable instructions, such as program modules, executed by one or more computers or other devices. The computer-executable instructions may be organized into one or more computer-executable components or modules. Aspects of the invention may be implemented with any number and organization of such components or modules. Generally, program modules include, but are not limited to, routines, programs, objects, components, and data structures that perform particular tasks or implement particular abstract data types. For example, aspects of the invention are not limited to the specific computer-executable instructions or the specific components or modules illustrated in the figures and described herein. Other embodiments of the invention may include different computer-executable instructions or components having more or less functionality than illustrated and described herein. Aspects of the invention may also be practiced in distributed computing environments where tasks are performed by remote processing devices that are linked through a communications network. In a distributed computing environment, program modules may be located in both local and remote computer storage media including memory storage devices.

In operation, the computer executes computer-executable instructions such as those illustrated in the figures to implement aspects of the invention.

The order of execution or performance of the operations in embodiments of the invention illustrated and described herein is not essential, unless otherwise specified. That is, the operations may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

When introducing elements of aspects of the invention or the embodiments thereof, the articles "a," "an," "the," and "said" are intended to mean that there are one or more of the elements. The terms "comprising," "including," and "having" are intended to be inclusive and mean that there may be additional elements other than the listed elements.

Having described aspects of the invention in detail, it will be apparent that modifications and variations are possible without departing from the scope of aspects of the invention as defined in the appended claims. As various changes could be made in the above constructions, products, and methods without departing from the scope of aspects of the invention, it is intended that all matter contained in the above description and shown in the accompanying drawings shall be interpreted as illustrative and not in a limiting sense.

What is claimed is:

1. A method of securing gaming transactions, said method comprising:

receiving, by one or more gaming systems, gaming transactions from one or more remote access devices, said gaming systems registering and storing the received gaming transactions in a first format, said gaming systems servicing transactions for one or more gaming jurisdictions or venues;

receiving, by a transaction server including a processor coupled to a memory, transaction data from the one or more of the gaming systems, said transaction data representing one or more of the received gaming transactions created for a game implemented by the one or more gaming systems, wherein the transaction server is operated independently of the one or more gaming systems;

digitally time-stamping, by the transaction server, the transaction data, using a hardware security module (HSM) that generates a digital time-stamp, said digital time-stamp being created by one or more of the following: Rivest-Shamir-Adleman (RSA) signature, digital signature algorithm (DSA), or elliptic curves signature;

storing, by the transaction server, the time-stamp data and the received transaction data such that an audit system can verify the gaming transactions with the time-stamp data and the received transaction data stored on the transaction server independent of verifying the gaming transaction stored by the one or more gaming systems; and providing the audit system access to the time stamp data and the received transaction data stored on the transaction server for verification;

wherein the received transaction data is stored by the transaction server in a second format.

2. The method of claim 1, wherein the transaction data represents a batch of a plurality of the transactions created during a pre-defined time interval.

3. The method of claim 1, further comprising:

accessing, by the audit system, the stored transaction data; and verifying the digital time-stamp associated with the stored transaction data.

4. The method of claim 1, wherein one or more non-transitory computer-readable media have computer-executable instructions for performing the method recited in claim 1.

5. A method of securing gaming transactions, said method comprising:

receiving, by a transaction server including a processor coupled to a memory, a one-way hash of transaction data from one or more gaming systems, said transaction data representing one or more gaming transactions from the one or more gaming systems, said one-way hash being calculated by the one or more gaming systems between a closing of sales of transactions for a game and a draw for the game, the one or more gaming systems receiving gaming transactions from one or more remote access devices, wherein the one or more gaming systems register and store the received gaming transactions, and the transaction server is operated independently of the one or more gaming systems;

defining descriptive information for the transaction data;

digitally time-stamping the defined descriptive information and the received one-way hash of the transaction data by the transaction server using a hardware security module (HSM) that generates a digital time-stamp, said digital time-stamp being created by one or more of the following: Rivest-Shamir-Adleman (RSA) signature, digital signature algorithm (DSA), or elliptic curves signature;

storing, by the transaction server, the time-stamp and the time-stamp data such that an audit system can verify the gaming transactions with the time-stamp data and the received transaction data stored on the transaction server independent of verifying the gaming transaction stored by the one or more gaming systems; and providing the audit system access to the time stamp data and the received transaction data stored on the transaction server for verification.

6. The method of claim 5, further comprising:

receiving, by the audit system, the transaction data from the one or more gaming systems;

calculating a one-way hash of the transaction data; and verifying the time-stamped defined descriptive information with the calculated one-way hash of the transaction data.

7. The method of claim 5, further comprising associating a transaction identifier with the time-stamped data to provide access to the time-stamped data via the associated transaction identifier, said transaction identifier comprising one or more elements each identifying the gaming transactions.

8. The method of claim 5, wherein receiving the one-way hash of transaction data comprises receiving a plurality of one-way hashes each associated with a batch of transaction data, wherein the time-stamped data is created for each of the received plurality of one-way hashes, and further comprising storing, on the transaction server, the received plurality of one-way hashes with the corresponding time-stamped data in order to enable verification.

9. The method of claim 5, wherein one or more non-transitory computer-readable media have computer-executable instructions for performing the method recited in claim 5.

10. A transaction server comprising:

a processor;

an interface, coupled to said processor, for receiving transaction data from one or more gaming systems, said transaction data representing a batch of transactions created for a game implemented by the gaming system, the one or more gaming systems receiving gaming transactions from one or more remote access devices, and wherein the one or more gaming systems register and store the gaming transactions;

a memory area, coupled to said processor, for storing the transaction data received by the interface; and a digital time-stamping means, associated with the transaction server, for digitally time-stamping the transaction data, wherein the digitally time-stamped transaction data secures the transaction data from undetectable tampering, and wherein the time-stamp and the time-stamped transaction data are stored in the memory area of the transaction server such that an audit system can verify the gaming transactions with the time-stamp and the time-stamped transaction data stored in the memory area of the transaction server independent of verifying the gaming transaction stored by the one or more gaming systems, wherein the digital time-stamping means includes a hardware security module (HSM) that generates a digital time-stamp, said digital time-stamp being created by one or more of the following: Rivest-Shamir-Adleman (RSA) signature, digital signature algorithm (DSA), or elliptic curves signature;

wherein the interface provides the audit system access to the time stamp data and the received transaction data stored on the transaction server for verification and said transaction server operates independently of the one or more gaming systems.

11. The transaction server of claim 10, wherein the audit system is configured for verifying the gaming transactions and communicating verified transaction data to the one or more gaming systems, said one or more gaming systems executing selection of one or more transactions from the verified transaction data.

12. The transaction server of claim 10, wherein the audit system is located remotely from the transaction server.

13. The transaction server of claim 10, wherein the audit system is located on the transaction server.

14. The transaction server of claim 10, wherein the batch of transactions represents transactions grouped via one or more of the following: a defined time interval and a defined quantity of transactions.

15. The method of claim 1, further comprising associating a transaction identifier with the time-stamped data to provide access to the time-stamped data via the associated transaction identifier, the transaction identifier comprising one or more elements each identifying the gaming transactions.

* * * * *